US006178305B1

(12) United States Patent
Sato

(10) Patent No.: US 6,178,305 B1
(45) Date of Patent: Jan. 23, 2001

(54) TONER CARTRIDGE INSTALLATION STRUCTURE FOR ELECTROPHOTOGRAPHIC MACHINE

(75) Inventor: Tsutomu Sato, Tokyo (JP)

(73) Assignee: Asahi Kogaku Kogyo Kabushiki Kaisha, Tokyo (JP)

( * ) Notice: Under 35 U.S.C. 154(b), the term of this patent shall be extended for 0 days.

(21) Appl. No.: 09/432,799

(22) Filed: Nov. 3, 1999

(30) Foreign Application Priority Data

Nov. 5, 1998 (JP) ..... 10-314626

(51) Int. Cl.[7] ..... G03G 15/08
(52) U.S. Cl. ..... 399/262; 399/111
(58) Field of Search ..... 399/106, 107, 399/110, 111, 114, 262; 347/138, 152

(56) References Cited

U.S. PATENT DOCUMENTS

| | | | | |
|---|---|---|---|---|
| 4,708,455 | * | 11/1987 | Kobota et al. | 399/111 |
| 4,984,023 | | 1/1991 | Yoshida | 399/106 |
| 5,740,500 | * | 4/1998 | Hashimoto | 399/114 |
| 5,745,822 | * | 4/1998 | Nishimura et al. | 399/106 |

* cited by examiner

*Primary Examiner*—Susan S. Y. Lee
*Assistant Examiner*—Hoan Tran

(74) *Attorney, Agent, or Firm*—Greenblum & Bernstein, P.L.C.

(57) ABSTRACT

A laser printer (10) uses an elongated toner cartridge (24) adapted for insertion into a toner cartridge slot (25) defined within a body housing (12) of the printer (10). The slot (25) is elongated in shape and extends horizontally. The toner cartridge (24) extends along the slot (25) when received in it. The slot (25) has a mouth at one longitudinal end through which the toner cartridge (24) is inserted in and removed from the slot (25). A slot door (26) is provided for the mouth of the slot. The slot door (26) is supported to be movable between a first position for substantially closing the mouth and a second position for leaving the mouth open. The slot door (26) has inner and outer sides, the inner side facing toward inside of the slot (25) when the slot door (26) is located at the first position while facing upward when the slot door (26) is located at the second position. The slot door (26) has guide surfaces formed on its inner side for guiding the toner cartridge to establish alignment of the toner cartridge (24) relative to the slot (25) preparatory to inserting the former into the latter. The slot door (26) includes a toner collector vessel (62) for collecting any toner falling down from a used toner cartridge during its removal from the slot (25). The slot door (26) facilitates toner cartridge replacement, prevents ambient light from entering the slot (25) and avoids contamination of environment of the printer (10) with toner.

8 Claims, 8 Drawing Sheets

TONER CARTRIDGE INSTALLATION STRUCTURE FOR ELECTROPHOTOGRAPHIC MACHINE

The present disclosure relates to subject matter contained in Japanese Patent Application No. Hei-10-314626 filed on Nov. 5, 1998, which is expressly incorporated herein by reference in its entirety.

BACKGROUND OF THE INVENTION

1. Field of the Invention

The present invention relates to a toner cartridge installation structure for an electrophotographic machine.

2. Description of the Related Art

There are used various electrophotographic machines, including electrostatic copiers, laser facsimile machines, laser printers and the like, for generating images by utilizing technique known as electrostatic photography. A typical electrophotographic machine uses a photosensitized medium, in the form of a drum or a belt, having a photosensitized surface made of photoconductive insulating material. A charging unit is used to place a uniform electrostatic charge over the photosensitized surface preparatory to imaging. Then, a desired light image is either projected by an optical system or drawn by a laser beam scanner on the photosensitized surface, to form an electrostatic latent image on the surface. Thereafter, the latent image is developed with a developing material, powdery material referred to in the art as toner, to form a powder image on that surface. The powder image is then transferred to and fixed onto a support surface, such as a surface of a sheet of paper.

For developing the latent image, such electrophotographic machines include a developer unit, which is designed to apply toner to the photosensitized surface having a latent image formed thereon, and a toner dispenser for dispensing toner into the developer unit. A typical toner dispenser comprises a dispenser roller cooperating with a toner reservoir, which may be also referred to as a toner hopper. The dispenser roller may comprise a foam roller, for example. During development process, toner is either continuously or periodically dispensed from the toner reservoir into the developer unit by means of the dispenser roller.

The toner reservoir reserves a supply of toner therein. After use of the machine for a certain length of time, such as several weeks or months, the supply of toner in the toner reservoir is depleted, necessitating toner replenishment in the machine. In order to allow the user to conduct toner replenishment operation in a quick and clean manner, toner cartridges are widely used. A typical toner cartridge comprises an elongated vessel filed with an amount of toner. The elongated vessel is adapted to be installed in the machine such that it extends in a horizontal direction. The toner cartridge has an elongated bottom opening for discharging toner, which extends along the length of the toner cartridge. Before installation, the bottom opening is kept closed by a suitable closure member, which may be, for example, a strip of removable sealing tape. After installation of the toner cartridge in the machine, the bottom opening is opened to accomplish toner replenishment. Typically, a toner cartridge of this type is designed to be left in position after installed, until it is replaced with a new one when the replenished amount of toner is again depleted.

Many of the electrophotographic machines using this type of toner cartridge have a toner cartridge slot, defined within a body housing of the machine, for receiving the toner cartridge therein for installation of the toner cartridge in the machine. Typically, the slot (i) is elongated in shape, (ii) extends horizontally and (iii) has a mouth at one longitudinal end, through which the toner cartridge is inserted in and removed from the slot. In such case, the toner cartridge replacement operation involves removal of a used toner cartridge from such slot and insertion of a new one into such slot. This operation, however, is not always easy, in particular when the toner cartridge is relatively large and heavy, due to the relatively tight geometry of the slot. Accordingly, there has been a desire for a suitable means for facilitating toner cartridge replacement operation for an electrophotographic machine having a toner cartridge slot of the above-mentioned type.

SUMMARY OF THE INVENTION

In view of the foregoing, it is an object of the present invention to provide a toner cartridge installation structure for an electrophotographic machine having such toner cartridge slot, in which the structure allows the operator to conduct toner cartridge replacement operation with great ease even when the toner cartridge is relatively large and heavy, as well as provides various other advantageous features.

In accordance with the present invention, there is provided a toner cartridge installation structure for an electrophotographic machine having a machine frame and a body housing enclosing the machine frame, wherein the electrophotographic machine uses an elongated toner cartridge for toner replenishment. The toner cartridge installation structure comprises a toner cartridge slot defined within the body housing for receiving therein the toner cartridge for installation of the toner cartridge in the electrophotographic machine. The slot (i) is elongated in shape, (ii) has a longitudinal axis extending in a first horizontal direction, (iii) is arranged such that the toner cartridge extends along the longitudinal axis of the slot when received in the slot and (iv) has a mouth at one longitudinal end thereof, through which the toner cartridge is inserted in and removed from the slot. The toner cartridge installation structure further comprises a slot door provided for the mouth of the slot, the slot door being supported by the machine frame so as to be movable between a first position for substantially closing the mouth and a second position for leaving the mouth open. The slot door has inner and outer sides, the inner side facing toward inside of the slot when the slot door is located at the first position while facing upward when the slot door is located at the second position. Further, the slot door has guide surfaces formed on the inner side thereof for guiding the toner cartridge to establish alignment of the toner cartridge relative to the slot preparatory to inserting the former into the latter.

The slot door may be preferably hinged to the machine frame for pivotal motion about a pivot axis, which extends below the mouth and in a second horizontal direction perpendicular to the first horizontal direction.

The slot door may preferably serve to substantially prevent ambient light from entering the slot when located at the first position.

The slot door may preferably comprise (i) a main wall having inner and outer surfaces substantially defining the inner and outer sides of the slot door, respectively, and (ii) edge walls extending upright from peripheral edges of the main wall toward the inner side of the slot door. The edge walls of the slot door serve both to (i) enhance prevention of ambient light from entering the slot achievable by the slot door and (ii) provide physical reinforcement of the slot door.

The guide surfaces of the slot door may be preferably adapted to guide the toner cartridge to establish alignment of the toner cartridge relative to the slot with respect to (i) orientation, (ii) vertical position and (iii) horizontal position along the second horizontal direction.

The toner cartridge may preferably have a substantially flat bottom surface with a pair of opposite, straight, parallel, side edges extending longitudinally of the toner cartridge, the bottom surface extending horizontally when the toner cartridge is installed in the electrophotographic machine. In such case, the slot door may comprise (i) a main wall having inner and outer surfaces defining the inner and outer sides of the slot door, respectively, and (ii) a pair of guide walls extending upright from the inner side of the slot door. The inner surface of the main wall has a flat surface portion which is so formed as to (i) extend horizontally when the slot door is located at the second position and (ii) serve to support the bottom surface of the toner cartridge, when the toner cartridge is placed thereon, to establish alignment of the toner cartridge relative to the slot with respect to vertical position. Further, the pair of guide walls (i) are substantially flat in shape, (ii) extend parallel to each other and in respective vertical planes along the first horizontal direction and (iii) serve to establish alignment of the toner cartridge relative to the slot with respect to orientation and horizontal position along the second horizontal direction.

The toner cartridge may preferably have a bottom opening which is kept closed with a closure member before installation of the toner cartridge and is opened after installation of the toner cartridge to allow discharge of toner therethrough. In such case, the slot door may comprise a toner collector vessel for collecting any toner falling from the toner cartridge through the bottom opening upon removal of the toner cartridge from the slot.

The electrophotographic machine may preferably comprise an elongated toner hopper housing which (i) is supported by the machine frame, (ii) has a longitudinal axis extending in the first horizontal direction and (iii) has a top opening. In such case, the slot may be defined above and along the toner hopper housing. The toner cartridge may have a bottom opening and may be adapted for detachable attachment on the toner hopper housing with the bottom thereof on the top of the toner hopper housing when installed in the electrophotographic machine. The top opening of the toner hopper housing and the bottom opening of the toner cartridge are adapted to mate with each other when the toner cartridge is attached on the toner hopper housing so as to allow discharge of toner therethrough from the toner cartridge into the toner hopper housing. The bottom opening of the toner cartridge is kept closed with a closure member before installation of the toner cartridge and is opened after installation of the toner cartridge. Further, the slot door comprises a toner collector vessel for collecting any toner falling from the toner cartridge through the bottom opening upon removal of the toner cartridge from the slot.

BRIEF DESCRIPTION OF THE DRAWINGS

The above and other objects, features and advantages of the present invention will be apparent from the following detailed description of a preferred embodiment thereof, reference being made to the accompanying drawings, in which.

DETAILED DESCRIPTION OF A PREFERRED EMBODIMENT

Referring now to the accompanying drawings, a preferred embodiment of the present invention will be described in detail.

Figure 1:
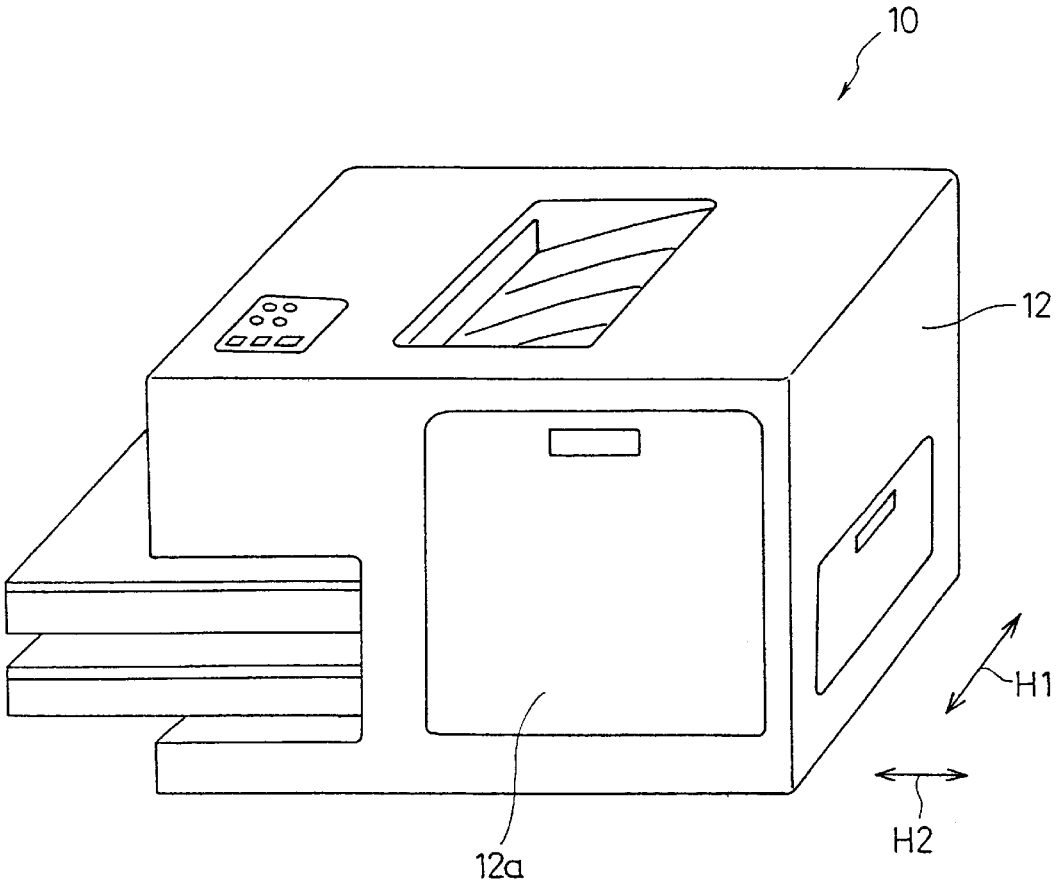
FIG. 1 is an electrophotographic machine, or a laser printer, using a toner cartridge installation structure constructed in accordance with a preferred embodiment of the present invention.
Figure 2:
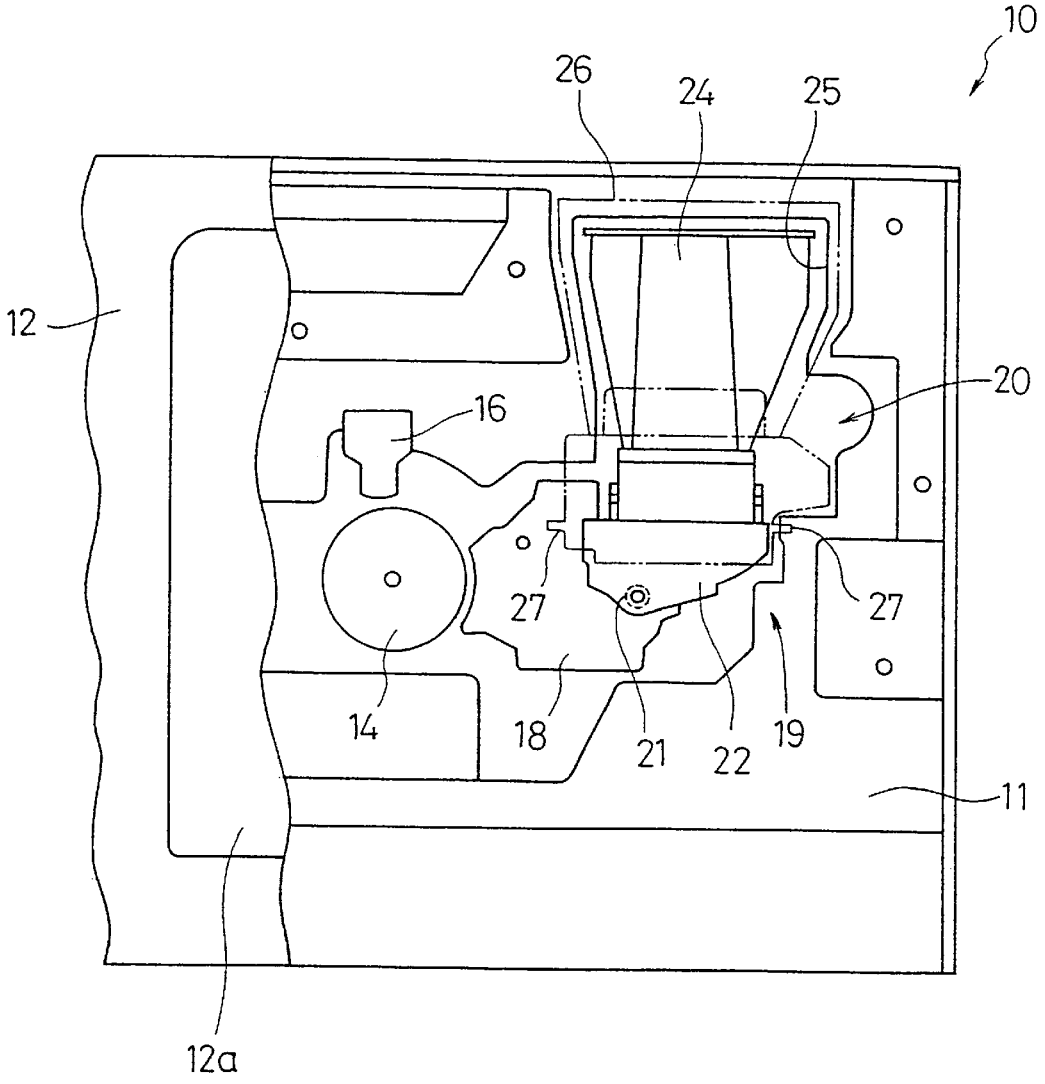
FIG. 2 is a front elevation, partially cut away, of a part of the laser printer of FIG. 1.
Figure 3:
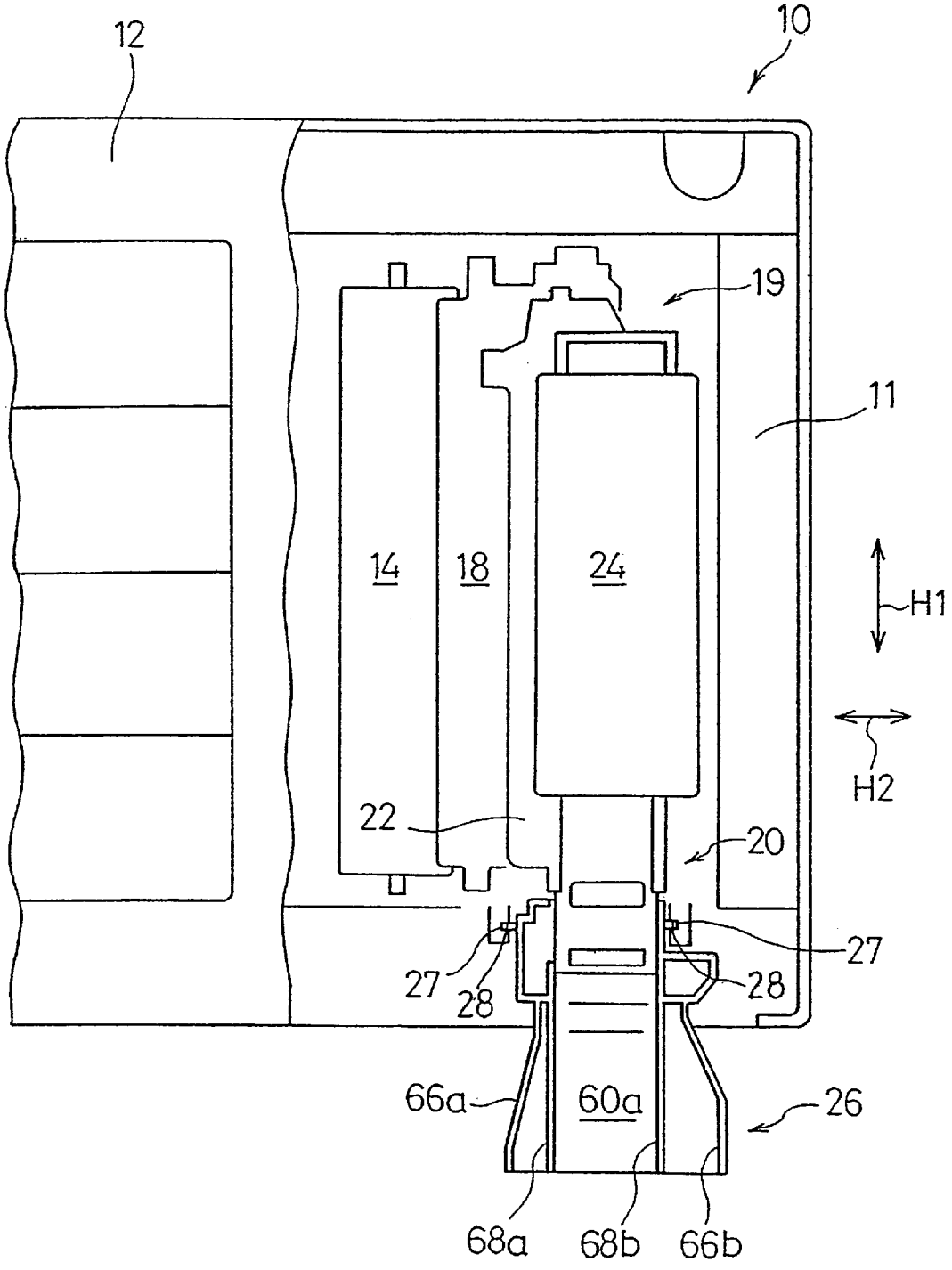
FIG. 3 is a plan view, partially cut away, of a part of the laser printer of FIG. 1.

FIGS. 1 to 3 show an electrophotographic machine using a toner cartridge installation structure constructed in accordance with a preferred embodiment of the present invention. The electrophotographic machine, generally designated by reference numeral 10, comprises a laser printer. The laser printer 10 has a machine frame 11 and a body housing 12 enclosing the machine frame 11. The body housing 12 has a front door 12*a* through which various elements and components of the laser printer 10 housed in the body housing 12 are accessible to the operator for maintenance, repair and toner replenishment purposes.

The laser printer 10 has a photosensitized drum 14, the outer periphery of which is coated with a suitable photoconductive material. The drum 14 is suitably journaled within the machine frame 11 for rotation in the direction by means of a suitable drive mechanism (not shown). The laser printer 10 further comprises a charging unit 16 for placing a uniform electrostatic charge over the photoconductive surface of the drum 14 preparatory to imaging.

Onto the charged photoconductive surface, a desired image (which may be a text image or a picture image) is drawn by means of an image drawing unit (not shown) utilizing a laser beam scanner for projecting a laser beam to be focused on the surface. Any regions exposed to the laser beam have the charge dissipated, so that an electrostatic latent image is created on the drum surface.

The laser printer 10 further comprises a developer unit 18 and a toner dispenser unit 19. The developer unit 18 serves to develop the electrostatic latent image with a developing material, powdery material referred to in the art as toner, so as to form a powder image corresponding to the latent image. The developer unit 18 comprises a toner applicator for applying toner to the charged regions of the drum surface to render the latent image visible. The toner applicator may be any conventional means for providing the required function. For example, it may comprise any kind of magnetic brushes known in the art.

The toner dispenser unit 19 comprises a toner reservoir 20 for reserving a supply of toner therein and a dispenser roller 21 for dispensing toner from the toner reservoir 20 into the developer unit 18 during development process. The dispenser roller 21 is housed within the toner reservoir 20 and disposed near the bottom of the toner reservoir 20. The dispenser roller 21 comprises a shaft and a cylindrical member made of a foam material and fitted over the shaft. The dispenser roller 21 is journaled for rotation about its axis and so disposed as to extend in a horizontal direction parallel to the photosensitized drum 14 of the developer unit 18. The dispenser roller 21 has its effective length substantially equal to the effective length of the photosensitized drum 14.

The toner reservoir 20 comprises a horizontally-extending, elongated container consisting of upper and lower vessels separable from each other. The lower vessel comprises a toner hopper housing 22, which is elongated in shape and supported by the machine frame 11 so as to extend in a horizontal direction. The upper vessel comprises a disposable toner cartridge 24, which is elongated in shape and adapted for detachable attachment on the toner hopper housing 22 with its bottom on the top of the toner hopper housing 22. Before use, the toner cartridge 24 is filled with an amount of toner to be replenished in the toner reservoir 20. Upon toner replenishment, the toner cartridge 24 is installed in the laser printer 10 and attached on the toner hopper housing 22. Thereafter, the toner cartridge 24 is left attached on the toner hopper housing 22 until a new toner cartridge is replaced for it.

Within the body housing 12, there is defined a toner cartridge slot 25 for receiving therein the toner cartridge 24, for installation of the toner cartridge 24 in the laser printer 10. The slot 25 is delimited partially by the machine frame 11, partially by the body housing 12 and partially by neighboring elements and components. The slot 25 is elongated in shape and has a longitudinal axis extending in a first horizontal direction, which is the direction from front to the back of the laser printer 10, as shown by arrow H1 in FIGS. 1 and 3. The slot 25 is arranged such that the toner cartridge 24 extends along the longitudinal axis of the slot 25 when received in the slot 25, as clearly seen from FIG. 2. The slot 25 has a mouth at one longitudinal end thereof (i.e., at its front end), through which the toner cartridge 24 is inserted in and removed from the slot 25.

Figure 4:
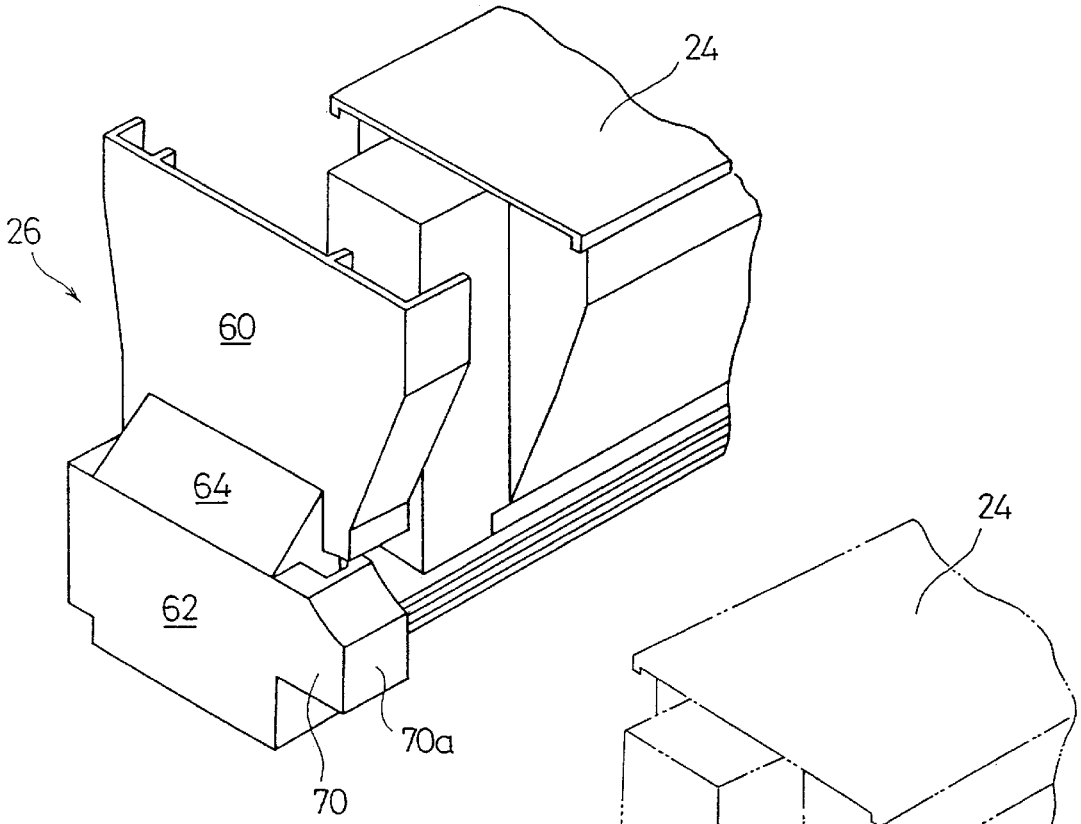
FIG. 4 is a perspective view showing a slot door for a toner cartridge slot used in the laser printer of FIG. 1, in which the slot door is located in a first position, together with a toner cartridge installed in position in the laser printer.
Figure 5:
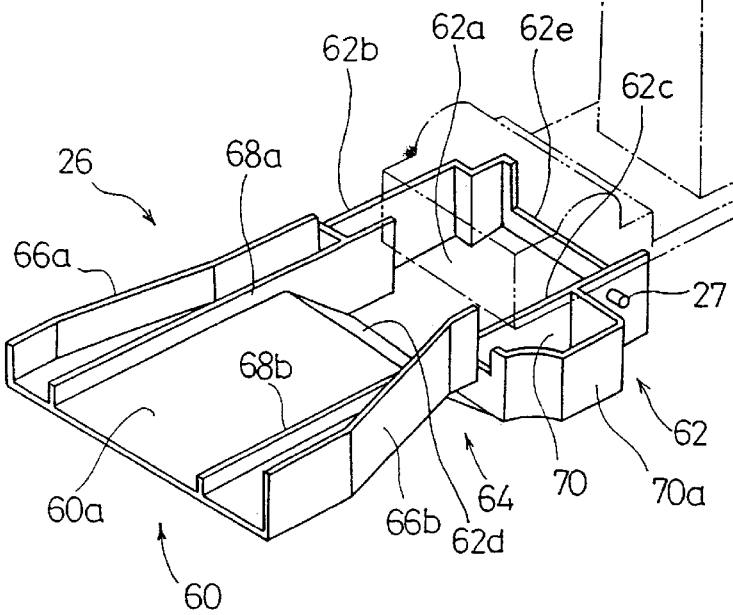
FIG. 5 is a perspective view, similar to FIG. 4, with the slot door located at a second position.
Figure 6:
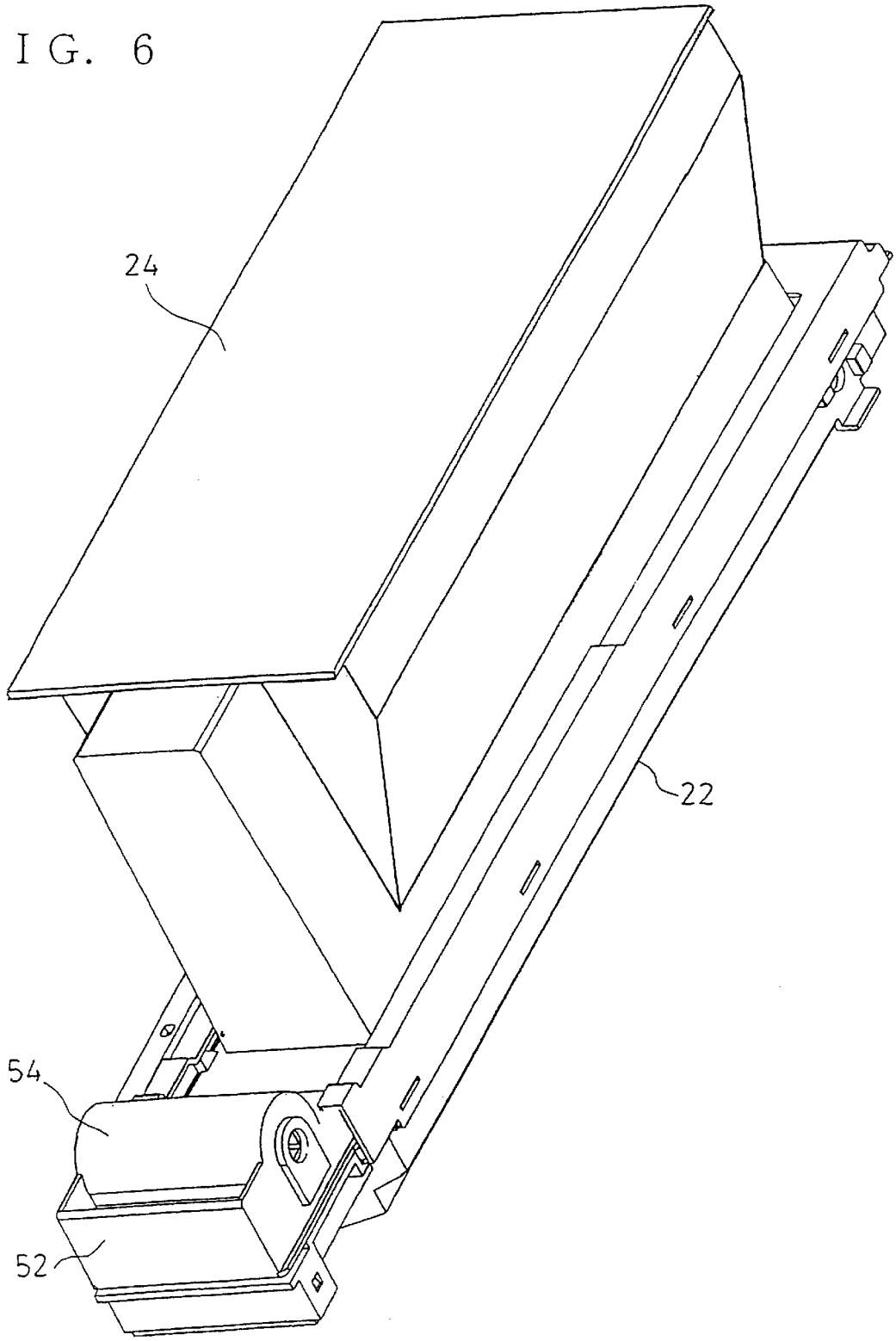
FIG. 6 is a perspective view of the toner cartridge attached on a toner hopper housing.

A slot door 26 is provided for the mouth of the slot 25. The slot door 26 has a pair of trunnions 27, which are received in respective holes 28 (FIG. 3) formed in corresponding portions of the machine frame 11. The slot door 26 is thereby hinged to the machine frame 11 for pivotal motion about a pivot axis which is defined by the trunnions 27 and the associated holes 28. The pivot axis extends below the mouth and in a second horizontal direction H2 (FIGS. 1 and 3) perpendicular to the first horizontal direction H1. In this manner, the slot door 26 is supported by the machine frame 11 so as to be movable between a first position for substantially closing the mouth (as shown in FIGS. 1 and 4) and a second position for leaving the mouth open (as shown in FIGS. 3 and 5). Note that FIG. 2 indicates the slot door 26 located at the first position by imaginary lines, in order to apparently show the toner cartridge 24 and the slot 25. Similarly, FIG. 5 indicates the toner cartridge 24 installed in position by imaginary lines, in order to clearly show the shape of the slot door 26.

As seen from FIGS. 4 and 5, the slot door 26 has inner and outer sides, the inner side facing toward inside of the slot 25 when the slot door 26 is located at the first position while facing upward when the slot door 26 is located at the second position. The slot door 26 has various advantageous geometrical features, many of which are closely related to the geometry and arrangement of the toner cartridge 24 and/or the toner hopper housing 22. Therefore, the toner cartridge 24 and the toner hopper housing 22 will be described in detail below prior to further description of the slot door 26.

As described above, the toner hopper housing 22 and the toner cartridge 24 together form the container serving as the toner reservoir 20, within which the dispenser roller 21 is housed and the supply of toner is reserved. The toner hopper housing 22 has a double-bottom structure comprising an inner bottom wall 34 and an outer bottom wall 36, in which the inner bottom wall 34 cooperates with the dispenser roller 21.

More specifically, as seen from FIGS. 6 through 9, the toner hopper housing 22 is a horizontally-extending, elongated vessel having its top substantially fully open. Accordingly, the toner hopper housing 22 defines a space for reserving toner therein and has an elongated top opening 40. The top opening 40 is generally rectangular in shape and extends longitudinally of the toner hopper housing 22. The top opening 40 extends along and just above the dispenser roller 21 so as to substantially cover the effective length of the dispenser roller 21.

The toner cartridge 24 has a casing, which is an elongated, box-shaped vessel having its bottom substantially fully open. Thus, the toner cartridge 24 has an elongated bottom opening 42, which is generally rectangular in shape and extends longitudinally of the toner cartridge 24.

The top opening 40 of the toner hopper housing 22 and the bottom opening 42 of the toner cartridge 24 are similar to each other in shape and size, and are adapted to mate with each other when the toner cartridge 24 is attached on the toner hopper housing 22, so as to allow discharge of toner therethrough from the toner cartridge 24 into the toner hopper housing 22.

Figure 7:
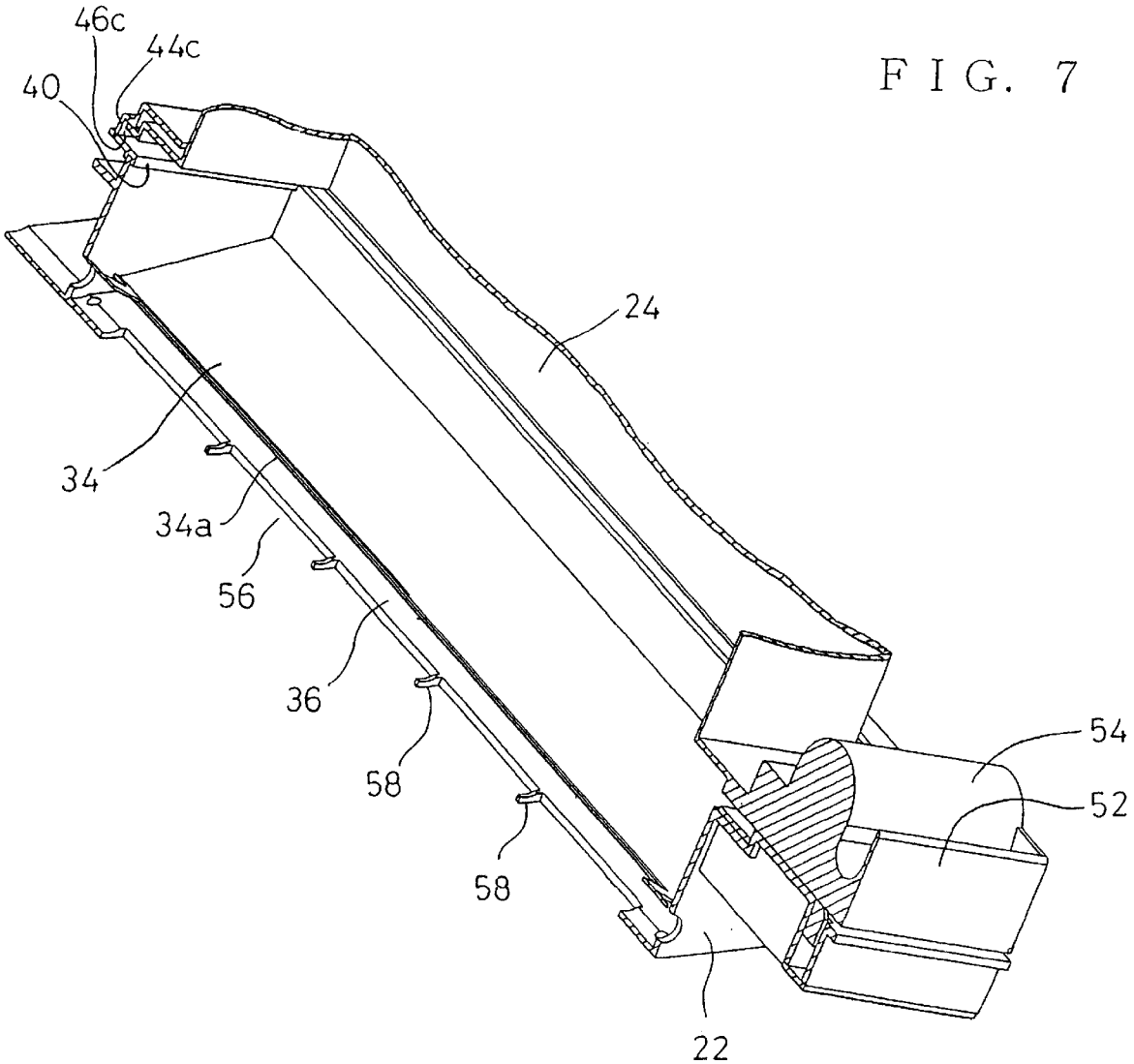
FIG. 7 is a perspective view, similar to FIG. 6 and partially cut away.
Figure 8:
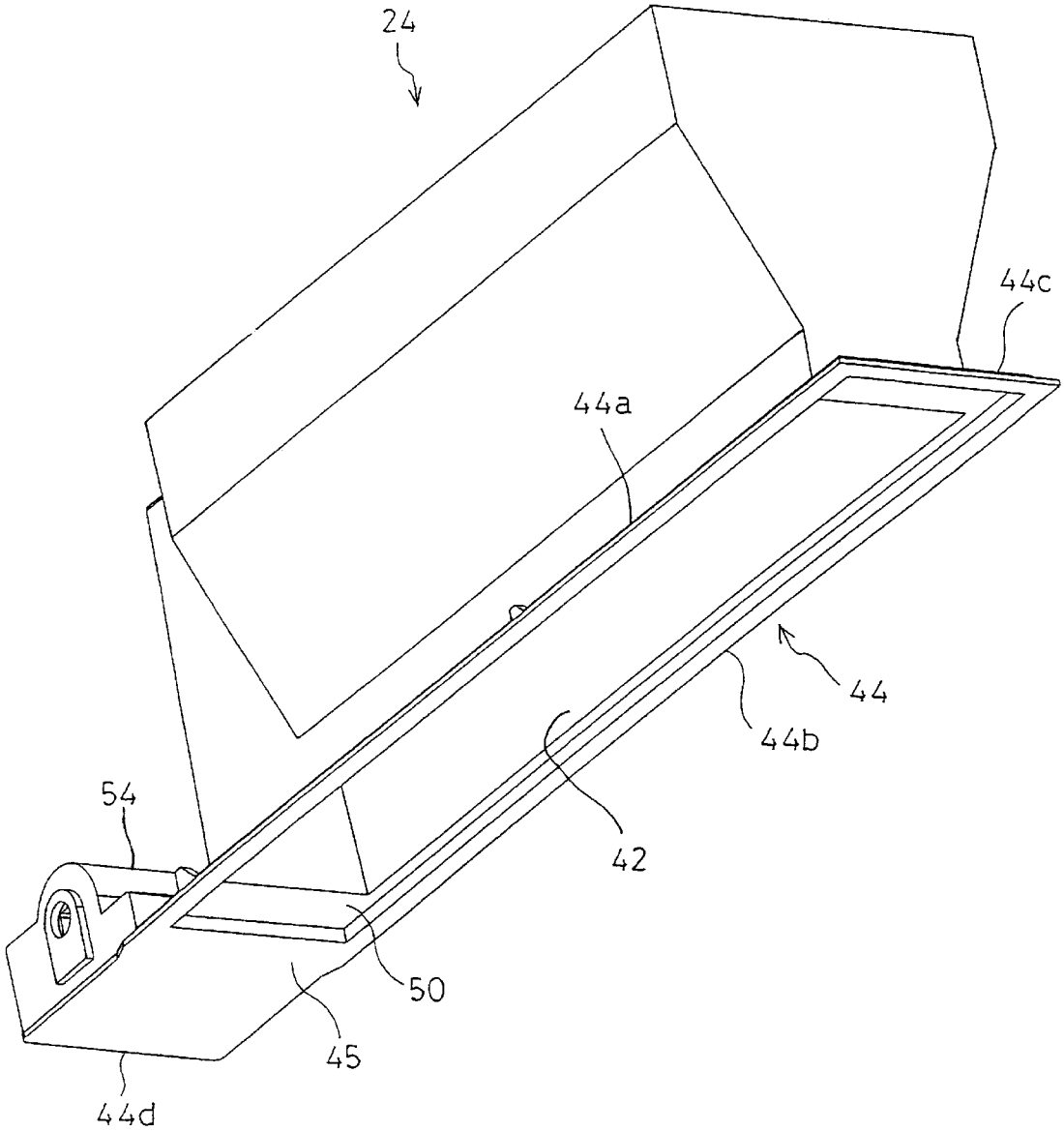
FIG. 8 is a perspective view showing an empty casing of the toner cartridge after removal of a strip of sealing tape.
Figure 9:
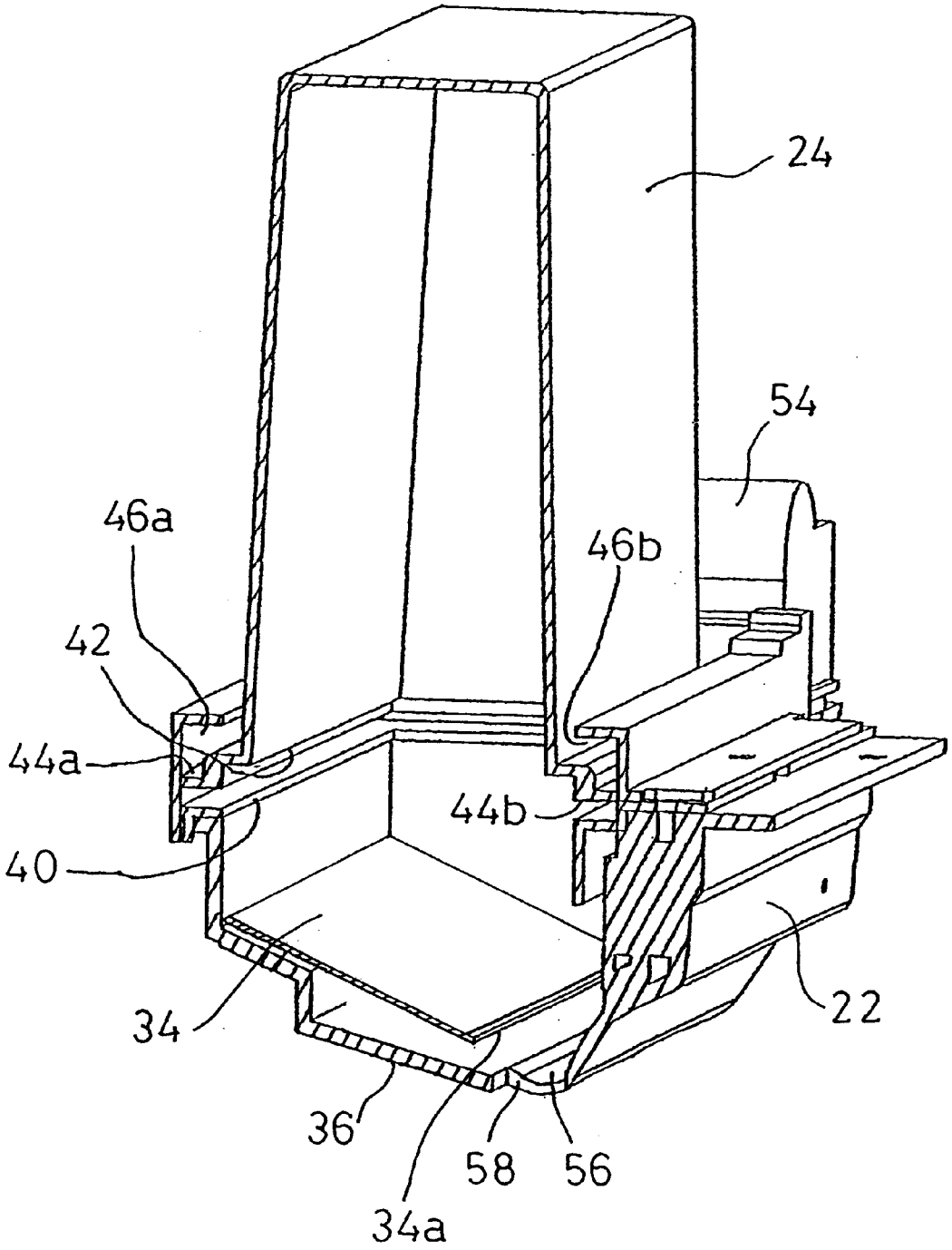
FIG. 9 is a perspective view showing the toner cartridge attached on the toner hopper housing, partially cut away along a cross-cutting plane.

As best seen from FIG. 8, the casing of the toner cartridge 24 has a bottom flange plate 44 extending outwardly from the edges of the bottom opening 42. The bottom flange plate 44 defines a flat bottom surface 45 of the toner cartridge 24, which extends horizontally when the toner cartridge 24 is attached on the toner hopper housing 22 and thereby installed in the laser printer 10. The bottom flange plate 44 has a rectangular outline, so that the bottom surface 45 has a pair of opposite side edges 44*a* and 44*b* and a pair of opposite end edges 44*c* and 44*d*. In correspondence thereto, the top opening 40 of the toner hopper housing 22 has four edges including a pair of side edges and a pair of end edges, among which the pair of side edges and one end edge are provided with respective groove-like receptacles 46*a*, 46*b* and 46*c* for receiving therein the pair of side edges 44*a* and 44*b* and the one end edge 44*c* of the toner cartridge 24, respectively. (The side-edge receptacles 46*a* and 46*b* are shown in FIG. 9, while the end-edge receptacle 46*c* is shown in FIG. 7.)

The pair of opposite side edges 44*a* and 44*b* of the bottom surface 45 of the toner cartridge 24 are straight and parallel, and extend longitudinally of the elongated toner cartridge 24. The side edges 44*a* and 44*b* can be slid into the corresponding side-edge receptacles 46*a* and 46*b*, respectively, of the toner hopper housing 22. With the end edge 44*c* of the toner cartridge 24 being received in the corresponding end-edge receptacle 46*c* of the toner hopper housing 22, the toner cartridge 24 is positioned on the toner hopper housing 22 and retained there by means of suitable click stops (not shown) provided between them. By virtue of this, the attachment/detachment of the toner cartridge 24 on/from the toner hopper housing 22 may be accomplished in a quick manner. The toner cartridge 24 has a handle portion 52 is formed at one end, which facilitates insertion/removal of the toner cartridge 24 into/from the slot 25 upon attachment/detachment thereof on/from the toner hopper housing 22.

As shown in FIG. 8, the bottom flange plate 44 of the toner cartridge 24 has a retracted surface 50 (retracted from the bottom surface 45 of the toner cartridge 24) defining the peripheral area of the bottom opening 42. The retracted surface 50 provides a sealing surface. After a measured amount of toner is filled in the toner cartridge 24, the bottom opening 42 of the toner cartridge 24 is closed with a closure member. The closure member comprises a strip of flexible, removable, sealing tape (not shown) adapted to be adhered to the sealing surface 50 so as to sealingly close the bottom opening 42. The sealing tape is made of a suitable plastic film material which can be strippably adhered onto any smooth surface by heating. The sealing tape is removed away to open the bottom opening 42 after the toner cartridge 24 is attached on the toner hopper housing 22. Accordingly, the bottom opening 42 is kept closed before installation of the toner cartridge 24 in the laser printer 10 and is opened after installation.

For facilitating removal of the sealing tape, i.e., stripping it from the sealing surface 50, the toner cartridge 24 has a tape take-up reel mechanism 54 provided on the bottom flange plate 44 and at one end of the toner cartridge 24. The far end of the sealing tape away from the reel mechanism 54 has a leader portion connecting the sealing tape to a tape take-up reel of the reel mechanism 54. Upon removal, the sealing tape is stripped along the length of the bottom opening 42 from the far end of the sealing tape to the near end thereof.

The laser printer 10 is provided with a drive mechanism (not shown) for the reel mechanism 54. The drive mechanism has a rotary handle (not shown) adapted to be driven by the operator's hand. After the toner cartridge 24 is attached on the toner hopper housing 22, the drive mechanism engages with the reel mechanism 54. Then, the operator can rotate the rotary handle to drive the reel mechanism 54 to remove away the sealing tape.

As described above, the toner hopper housing 22 has the double-bottom structure comprising the inner bottom wall 34 and the outer bottom wall 36 (FIGS. 7 and 9). The outer bottom wall 36 is formed as an integral part of the toner hopper housing 22 itself. The outer bottom wall 36 has a toner dispensing slit 56 formed therein, which extends along and just under the dispenser roller 21 (FIG. 2) to cover the entire length of the dispenser roller 21, so that any toner falling down off the surface of the dispenser roller 21 may pass through the slit 56 to exit the toner hopper housing 22 into the developer unit 18 (FIG. 2). The toner hopper housing 22 also has a plurality of bridges 58 (FIGS. 7 and 9) connecting opposite edges of the slit 56 for reinforcement of the toner hopper housing 22.

The inner bottom wall 34 comprises a flat, thin, generally rectangular plate slanting down with a shallow slant from one of the side walls of the toner hopper housing 22 toward the dispenser roller 21 to terminate at a lip edge 34*a*. The lip edge 34*a* of the inner bottom wall 34 extends along and covers the entire length of the dispenser roller 21, and is kept in engagement with the cylindrical surface of the dispenser roller 21.

The outer bottom wall 36 extends below the inner bottom wall 34 to provide protection for the inner bottom wall 34 and the dispenser roller 21, while the combination of the inner bottom wall 34 and the dispenser roller 21 provides the essential function of the bottom, i.e., the combination serves to retain the supply of toner in the toner reservoir 20 by preventing it from freely flowing down out of the toner reservoir 20. By virtue of cooperation of the inner bottom wall 34 with the dispenser roller 21, only a controlled dose of toner per unit of time, which depends on the rotational speed of the dispenser roller 21, is caused to pass through the area of engagement between the dispenser roller 21 and the lip edge 34*a* of the inner bottom wall 34 and fall down through the toner dispensing slit 56 formed in the outer bottom wall 36 into the developer unit 18. This manner of dispensing toner is based on the adhesive nature of toner to the foam material of the dispenser roller 21, as is well known in the art.

Referring now to FIGS. 2 to 5, various geometrical features of the slot door 26 will be described in great detail. Upon installation of the toner cartridge 24 in the laser printer 10, the toner cartridge 24 is inserted into the toner cartridge slot 25 and attached on the toner hopper housing 22, as described above. Before such insertion and attachment of the toner cartridge 24, it is necessary to establish alignment of the toner cartridge 24 relative to the slot 25, and thus to the toner hopper housing 22. According to the present invention, the slot door 26 effectively serves to guide the toner cartridge 24 so as to establish such alignment preparatory to inserting the toner cartridge 24 into the slot 25. The slot door 26 may provide further advantageous functions including prevention of ambient light from entering. the slot 25, as well as collection of any toner falling down from the used toner cartridge 24 upon its removal from the slot 25, so as to avoid contamination of environment of the laser printer 10 with such toner, all of which will be apparent from the following description.

The slot door 26 is a one-piece molded component made of a suitable plastic material. As best seen from FIGS. 4 and 5, the slot door 26 is formed as a combination of a number of flat walls. Specifically, as shown in FIG. 4, the slot door 26 comprises a main wall 60, a toner collector vessel 62 and a bridge 64 interconnecting the main wall 60 and the toner collector vessel 62. The main wall 60 is a flat wall extending vertically when the slot door 26 is located at the first position (FIG. 4), and horizontally when the slot door 26 is located at the second position (FIG. 5). The main wall 60 has inner and outer surfaces substantially defining the inner and outer sides of the slot door 26, respectively. The slot door 26 further comprises a pair of edge walls 66*a* and 66*b*, each comprising three continuously-jointed flat walls bent at their joints. The edge walls 66*a* and 66*b* extend upright from peripheral edges of the main wall 60 toward the inner side of the slot door 26, as shown in FIG. 5.

The slot door 26 has its extension large enough to entirely cover the mouth of the slot 25, as shown in FIG. 2, so that it serves to substantially prevent ambient light from entering the slot 25 when located at the first position. Any ambient light which could enter the slot 25 would reach the photosensitized surface of the drum 14, resulting in possible deterioration in quality of the photosensitized surface, as is well known in the art. The edge walls 66*a* and 66*b* serve to enhance prevention of ambient light from entering the slot 25 achievable by the slot door 26, as well as to provide physical reinforcement of the slot door 26.

As previously described, the slot door 26 serves to guide the toner cartridge 24 so as to establish alignment of the toner cartridge 24 relative to the slot 25 preparatory to inserting the former into the latter. For the purpose, the slot door 26 has guide surfaces formed on the inner side of the slot door 26. Specifically, the slot door 26 has a pair of guide walls 68*a* and 68*b* extending upright from the inner surface of the main wall 60, and thus from the inner side of the slot door 26. The pair of guide walls 68*a* and 68*b* are flat in shape, as shown in FIG. 5, and extend parallel to each other in respective vertical planes along the first horizontal direction H1, as shown in FIG. 3. Thus, the guide walls 68*a* and 68*b* have inner surfaces facing to each other, with the space between the inner surfaces corresponding to the width of the bottom surface 45 of the toner cartridge 24, i.e., the distance between the opposite side edges 44*a* and 44*b* of the bottom surface 45. The inner surfaces of the guide walls 68*a* and 68*b* constitute two of the guide surfaces of the slot door 26, and are called the "vertical guide surfaces" hereinafter. In addition, the portion of the inner surface of the main wall 60 between the guide walls 68*a* and 68*b* constitute a third one of the guide surfaces of the slot door 26. This is called the "horizontal guide surface" since it extends horizontally when the slot door 26 is located at the second position, as shown in FIGS. 3 and 5. In these figures, the horizontal guide surface is designated by reference numeral 60*a*.

When the slot door 26 is at the second position, the horizontal guide surface 60*a* is substantially level with the top of the toner hopper housing 22. More exactly, we define here, for convenience, a reference horizontal plane as such plane in that the bottom surface 45 of the toner cartridge 24 extends when the latter has been installed in the slot 25 and attached on the top of toner hopper housing 22. Using this definition, the horizontal guide surface 60*a* is substantially coincident with the reference horizontal plane when the slot door 26 is at the second position. This incidence is utilized to establish alignment of the toner cartridge 24 relative to the slot 25 with respect to vertical position upon installation of the former in the latter, as detailed in the following.

For insertion of the toner cartridge 24 into the slot 25, the slot door 26 has to be set open and located at the second position. The operator, wishing to insert the toner cartridge 24 into the slot 25, places the toner cartridge 24 on the slot door 26, when the end of the toner cartridge 24 far from the reel mechanism 54 is placed on the horizontal guide surface 60*a* while the other end of the toner cartridge 24 is still supported by the operator's hand. Upon placement of the toner cartridge 24 on the slot door 26 in this manner, the horizontal guide surface 60*a* serves to support the bottom surface 45 of the toner cartridge 24 so as to establish alignment of the toner cartridge 24 relative to the slot 25 with respect to vertical position. At the same time, the vertical guide surfaces, or the inner surfaces of the parallel guide walls 68*a* and 68*b*, engages with the opposite side edges 44*a* and 44*b* of the toner cartridge 24, so that the guide walls 68*a* and 68*b* serve to establish alignment of the toner cartridge 24 relative to the slot 25 with respect to orientation and horizontal position along the second horizontal direction H2.

Accordingly, the three guide surfaces of the slot door 26 are adapted to guide the toner cartridge 24 to establish alignment of the toner cartridge 24 relative to the slot 25 with respect to (i) orientation, (ii) vertical position and (iii) horizontal position along the second horizontal direction H2. Thereafter, the operator is only required to slide the toner cartridge 24 into the slot 25 in order to accomplish appropriate installation of the toner cartridge 24 in the laser printer 10. In this manner, even relatively large and heavy toner cartridges may be quickly installed with great ease.

The toner collector vessel 62 of the slot door 26 constitutes a proximal portion of the door 26, at which above-mentioned trunnions 27 are provided. When the slot door 26 is at the second position as shown in FIG. 5, the toner collector vessel 62 faces upward, so that it is capable of collecting any toner falling down into it. As described above, the toner cartridge 24 has the bottom opening 42 which is kept closed before installation of the toner cartridge 24 and is opened after installation. Thus, when a used toner cartridge is replaced with a new one, the bottom opening 42 of the used toner cartridge is open. Although a used toner cartridge is substantially empty of toner, there must be left a little toner loosely adhered on the inner wall surfaces of the used toner cartridge, and some of such toner will inevitably fall down through the bottom opening 42 of the toner cartridge during its removal from the slot 25. The toner collector vessel 62 of the slot door 26 serves to collect any such toner. After completion of removal of the used toner cartridge, the operator can wipe the inside of the toner collector vessel 62 with a piece of paper or cloth, so that contamination of environment of the laser printer 10 with such toner may be effectively eliminated or reduced.

As shown in FIG. 5, the toner collector vessel 62 has a bottom wall 62*a*, a pair of side walls 62*b* and 62*c* extending upright from the bottom wall 62*a* and being continuous to the guide walls 68*a* and 68*b*, a slant wall 62*d* forming a part of the bridge 64 and interconnecting the horizontal guide surface 60*a* and the bottom wall 62*a*, and an end wall 62*e* extending upright from the bottom wall 62*a* and interconnecting the side walls 62*b* and 62*c*. When the slot door 26 is at the second position as shown in FIG. 5, the level of the bottom wall 62*a* is lower than that of the horizontal guide surface 60*a*. The side walls 62*b* and 62*c*, the slant wall 62*d* and the end wall 62*e* together completely surround the bottom wall 62*a* to effectively prevent any collected toner from escaping out of the toner collector vessel 62. In particular, the end wall 62*e* has a height sufficient for this purpose.

The slot door 26 further comprises a small chamber 70 formed on one side of the toner collector vessel 62, in which the drive mechanism for the reel mechanism 54 of the toner cartridge 24 is housed when the slot door 26 is located at the first position to close the mouth of the slot 25. The outer wall 70*a* of the chamber 70 is engageable, when the slot door 26 is at the first position, with a shallow recess (not shown) formed in the machine frame 11 at an appropriate location. Their engagement serves to retain the slot door 26 at the first position, where the slot door 26 has to be located during normal operation of the laser printer 10.

As seen from FIG. 4, the toner collector vessel 62 has a relatively large, flat bottom wall, the outer surface of which is adapted for engagement, when the slot door 26 is at the second position, with a flat surface region (not shown) of the machine frame 11. Their engagement serves to retain the slot door 26 at the second position, where the slot door 26 is located during toner cartridge replacement. The relatively large, flat bottom wall is highly advantageous for the slot door 26 to bear a part of the weight of the toner cartridge to be installed/removed in/from the laser printer 10, in particular when the toner cartridge is relatively large and heavy.

Having described the present invention with reference to the preferred embodiment thereof, it is to be understood that the present invention is not limited to the disclosed embodiment, but may be embodied in various other forms without departing from the spirit and the scope of the present invention as defined by the appended claims.

What is claimed is:

1. A toner cartridge installation structure for an electrophotographic machine having a machine frame and a body housing enclosing said machine frame, wherein said electrophotographic machine uses an elongated toner cartridge for toner replenishment, comprising:

a toner cartridge slot defined within said body housing for receiving therein said toner cartridge for installation of said toner cartridge in said electrophotographic machine, said slot (i) being elongated in shape, (ii) having a longitudinal axis extending in a first horizontal direction, (iii) being arranged such that said toner cartridge extends along said longitudinal axis of said slot when received in said slot and (iv) having a mouth at one longitudinal end thereof, through which said toner cartridge is inserted in and removed from said slot;

a slot door provided for said mouth of said slot, said slot door being supported by said machine frame so as to be movable between a first position for substantially closing said mouth and a second position for leaving said mouth open;

said slot door having inner and outer sides, said inner side facing toward inside of said slot when said slot door is located at said first position while facing upward when said slot door is located at said second position; and said slot door having guide surfaces formed on said inner side thereof for guiding said toner cartridge to establish alignment of said toner cartridge relative to said slot preparatory to inserting the former into the latter.

2. A toner cartridge installation structure according to claim 1, wherein:

said slot door is hinged to said machine frame for pivotal motion about a pivot axis, which extends below said mouth and in a second horizontal direction perpendicular to said first horizontal direction.

3. A toner cartridge installation structure according to claim 2, wherein:

said slot door serves to substantially prevent ambient light from entering said slot when located at said first position.

4. A toner cartridge installation structure according to claim 3, wherein:

said slot door comprises (i) a main wall having inner and outer surfaces substantially defining said inner and outer sides of said slot door, respectively, and (ii) edge walls extending upright from peripheral edges of said main wall toward said inner side of said slot door; and said edge walls of said slot door serve both to (i) enhance prevention of ambient light from entering said slot achievable by said slot door and (ii) provide physical reinforcement of said slot door.

5. A toner cartridge installation structure according to claim 2, wherein:

said guide surfaces of said slot door are adapted to guide said toner cartridge to establish alignment of said toner cartridge relative to said slot with respect to (i) orientation, (ii) vertical position and (iii) horizontal position along said second horizontal direction.

6. A toner cartridge installation structure according to claim 5, wherein:

said toner cartridge has a substantially flat bottom surface with a pair of opposite, straight, parallel, side edges extending longitudinally of said toner cartridge, said bottom surface extending horizontally when said toner cartridge is installed in said electrophotographic machine;

said slot door comprises (i) a main wall having inner and outer surfaces defining said inner and outer sides of said slot door, respectively, and (ii) a pair of guide walls extending upright from said inner side of said slot door;

said inner surface of said main wall has a flat surface portion which is so formed as to (i) extend horizontally when said slot door is located at said second position and (ii) serve to support said bottom surface of said toner cartridge, when said toner cartridge is placed thereon, to establish alignment of said toner cartridge relative to said slot with respect to vertical position; and said pair of guide walls (i) are substantially flat in shape, (ii) extend parallel to each other and in respective vertical planes along said first horizontal direction and (iii) serve to establish alignment of said toner cartridge relative to said slot with respect to orientation and horizontal position along said second horizontal direction.

7. A toner cartridge installation structure according to claim 2, wherein:

said toner cartridge has a bottom opening which is kept closed with a closure member before installation of said toner cartridge and is opened after installation of said toner cartridge to allow discharge of toner therethrough; and said slot door comprises a toner collector vessel for collecting any toner falling from said toner cartridge through said bottom opening upon removal of said toner cartridge from said slot.

8. A toner cartridge installation structure according to claim 2, wherein:

said electrophotographic machine comprises an elongated toner hopper housing which (i) is supported by said machine frame, (ii) has a longitudinal axis extending in said first horizontal direction and (iii) has a top opening;

said slot is defined above and along said toner hopper housing;

said toner cartridge has a bottom opening and is adapted for detachable attachment on said toner hopper housing with the bottom thereof on the top of said toner hopper housing when installed in said electrophotographic machine;

said top opening of said toner hopper housing and said bottom opening of said toner cartridge are adapted to mate with each other when said toner cartridge is attached on said toner hopper housing so as to allow discharge of toner therethrough from said toner cartridge into said toner hopper housing;

said bottom opening of said toner cartridge is kept closed with a closure member before installation of said toner cartridge and is opened after installation of said toner cartridge; and said slot door comprises a toner collector vessel for collecting any toner falling from said toner cartridge through said bottom opening upon removal of said toner cartridge from said slot.

* * * * *